US010933439B2

(12) United States Patent
Bukovitz et al.

(10) Patent No.: US 10,933,439 B2
(45) Date of Patent: Mar. 2, 2021

(54) PAINT ROLLER FRAME AND CAGE ASSEMBLY AND METHOD OF MANUFACTURING

(71) Applicant: The Wooster Brush Company, Wooster, OH (US)

(72) Inventors: Richard K. Bukovitz, Orrville, OH (US); John L. Scott, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 236 days.

(21) Appl. No.: 16/167,432

(22) Filed: Oct. 22, 2018

(65) Prior Publication Data

US 2019/0118216 A1 Apr. 25, 2019

Related U.S. Application Data

(60) Provisional application No. 62/576,771, filed on Oct. 25, 2017.

(51) Int. Cl.
*B05C 17/02* (2006.01)

(52) U.S. Cl.
CPC ..... *B05C 17/0217* (2013.01); *B05C 17/02* (2013.01); *B05C 17/0205* (2013.01); *B05C 17/0207* (2013.01); *B05C 17/0245* (2013.01)

(58) Field of Classification Search
CPC . B05C 17/02; B05C 17/0207; B05C 17/0217; B05C 17/0205; B05C 17/0245
USPC ..... 15/230.11; 492/17, 19
See application file for complete search history.

(56) References Cited

U.S. PATENT DOCUMENTS

| | | | | |
|---|---|---|---|---|
| 4,385,431 | A | 5/1983 | Holton | |
| 4,834,603 | A | 5/1989 | Holton | |
| 5,210,899 | A * | 5/1993 | Goldstein | B05C 17/02 15/230.11 |
| 5,345,648 | A | 9/1994 | Graves | |
| 5,490,303 | A | 2/1996 | Graves | |
| 6,378,158 | B1 * | 4/2002 | Bukovitz | B05C 17/02 15/230.11 |
| D473,055 | S * | 4/2003 | Mann | D4/122 |

* cited by examiner

*Primary Examiner* — Laura C Guidotti
(74) *Attorney, Agent, or Firm* — Renner, Otto, Boisselle & Sklar, LLP

(57) ABSTRACT

A paint roller frame and cage assembly and method of manufacturing includes providing an assembly having a handle and a shaft extending from the handle, and forming a unitary cage having a radially outward surface for supporting a roller cover. The cage includes a first cavity located at an end of the cage proximate the handle and a second cavity located at an opposite end of the cage. Each cavity is defined within the radially outward surface and has a radially opening slot. A cover retainer is receivable through a first slot and into the first cavity. The cover retainer includes radially extending fingers that extend through the slot to engage an inner diameter of the roller cover and secure the cover to the cage. A fastener is receivable through a second slot and into the second cavity to hold the cage on the shaft.

17 Claims, 9 Drawing Sheets

PAINT ROLLER FRAME AND CAGE ASSEMBLY AND METHOD OF MANUFACTURING

This application claims the benefit of U.S. Provisional Application No. 62/576,771 filed Oct. 25, 2017, the contents of which are incorporated herein by reference.

FIELD OF INVENTION

The present invention relates generally to a paint roller frame and cage assembly and method of manufacturing that facilitates quick assembly and effects securement of the assembly components after assembly and during use.

BACKGROUND

Conventional paint roller and cage assemblies may be deficient in providing both securement of a roller cover to the roller cage during use and easy removal and replacement of the roller cover. For example, a paint roller and cage assembly that enables the roller cover to be easily inserted over the roller cage and easily removable from the cage may not also be configured to positively and securely retain the roller cover during use of the paint roller and cage assembly. Alternatively, a paint roller and cage assembly that is configured to provide more force to hold the roller cover to the cage during use may require an undesirable amount of force to insert and remove the cover from the cage.

Prior attempts to provide a paint roller and cage assembly that enables both securement of the roller cover and easy insertion and removal of the roller cover from the cage body have included providing numerous additional components such as end caps, fasteners, washers, bushings, etc. However, using numerous additional components may be disadvantageous in that the manufacturing process and assembly of the paint roller and cage may be complex.

SUMMARY OF INVENTION

The present invention provides a paint roller frame and cage assembly and method of manufacturing that enables easy insertion of a paint roller frame shaft into a roller cage and easy insertion or removal of a roller cover over the roller cage, while also effecting securement between the roller cage and both the shaft and the roller cover. The roller cage includes a cavity for receiving a cover retainer that engages the inner diameter of the roller cover to secure the roller cover to the cage. The cavity has a slot through which the cover retainer may radially pass to be easily inserted, or "dropped" into the cavity. The roller cage includes another cavity and "drop-in" slot to accommodate a push-on fastener that holds the roller cage onto the wire frame of the paint roller. The roller cage is advantageous in that the roller cage may be formed as a single injection-molded component with molded cavities and slots that enable quick and easy assembly, while the fastener and the cover retainer received within the cavities provide securement between the components during painting.

According to one aspect of the present invention, a paint roller frame and cage assembly includes a paint roller frame having a handle portion and a shaft portion that extends from the handle portion and a paint roller cage being rotatably mounted on the shaft portion. The paint roller cage has a radially outward surface for uniformly supporting a roller cover thereon and a first cavity having a first slot opening radially to the radially outward surface of the paint roller cage. The assembly includes a cover retainer receivable within the first cavity for securing a roller cover to the paint roller cage and the first slot has a width to allow the cover retainer to pass radially into the first cavity from outside the paint roller cage.

According to another aspect of the present invention, a paint roller frame and cage assembly includes a paint roller frame having a handle portion and a shaft portion that extends from the handle portion and a paint roller cage being rotatably mounted on the shaft portion. The paint roller cage has a radially outward surface for uniformly supporting a roller cover thereon and a cavity having a slot opening radially to the radially outward surface of the paint roller cage. The assembly includes a push-on fastener receivable within the cavity and the push-on fastener has an inner diameter that receives the shaft portion therethrough to hold the paint roller cage onto the shaft portion. The slot has a width to allow the fastener to pass radially into the cavity from outside the paint roller cage.

According to another aspect of the present invention, a paint roller frame and cage assembly includes a paint roller frame having a handle portion and a shaft portion that extends from the handle portion and a paint roller cage being rotatably mounted on the shaft portion. The paint roller cage has a radially outward surface for uniformly supporting a roller cover thereon, a first cavity located at one end of the paint roller cage that has a first slot opening radially to the radially outward surface of the paint roller cage, and a second cavity located at an opposite end of the paint roller cage that has a second slot opening radially to the radially outward surface of the paint roller cage. The assembly includes a cover retainer receivable within the first cavity for securing a roller cover to the paint roller cage and the first slot has a width to allow the cover retainer to pass radially into the first cavity from outside the paint roller cage. The assembly further includes a push-on fastener receivable within the second cavity to hold the paint roller cage onto the shaft portion and the second slot has a width to allow the push-on fastener to pass radially into the second cavity from outside the paint roller cage. The paint roller cage is formed as a unitary body and the radially outward surface extends continuously from the first end of the paint roller cage to the second end of the paint roller cage.

According to another aspect of the present invention, a paint roller frame and cage assembly includes a paint roller frame having a handle portion and a shaft portion that extends from the handle portion and a paint roller cage being rotatably mounted on the shaft portion. The paint roller cage has a radially outward surface for uniformly supporting a roller cover thereon, a first cavity located at one end of the paint roller cage that has a first slot opening radially to the radially outward surface of the paint roller cage, and a second cavity located at an opposite end of the paint roller cage that has a second slot opening radially to the radially outward surface of the paint roller cage. The assembly includes a cover retainer receivable within the first cavity for securing a roller cover to the paint roller cage, wherein the first slot has a width to allow the cover retainer to pass radially into the first cavity from outside the paint roller cage. The assembly includes a push-on fastener receivable within the second cavity to hold the paint roller cage onto the shaft portion, wherein the second slot has a width to allow the push-on fastener to pass radially into the second cavity from outside the paint roller cage. The paint roller cage is formed as a unitary body and the radially outward surface extends continuously from the first end of the paint roller cage to the second end of the paint roller cage.

The foregoing and other features of the invention are hereinafter described in greater detail with reference to the accompanying drawings.

DETAILED DESCRIPTION

Figure 1:
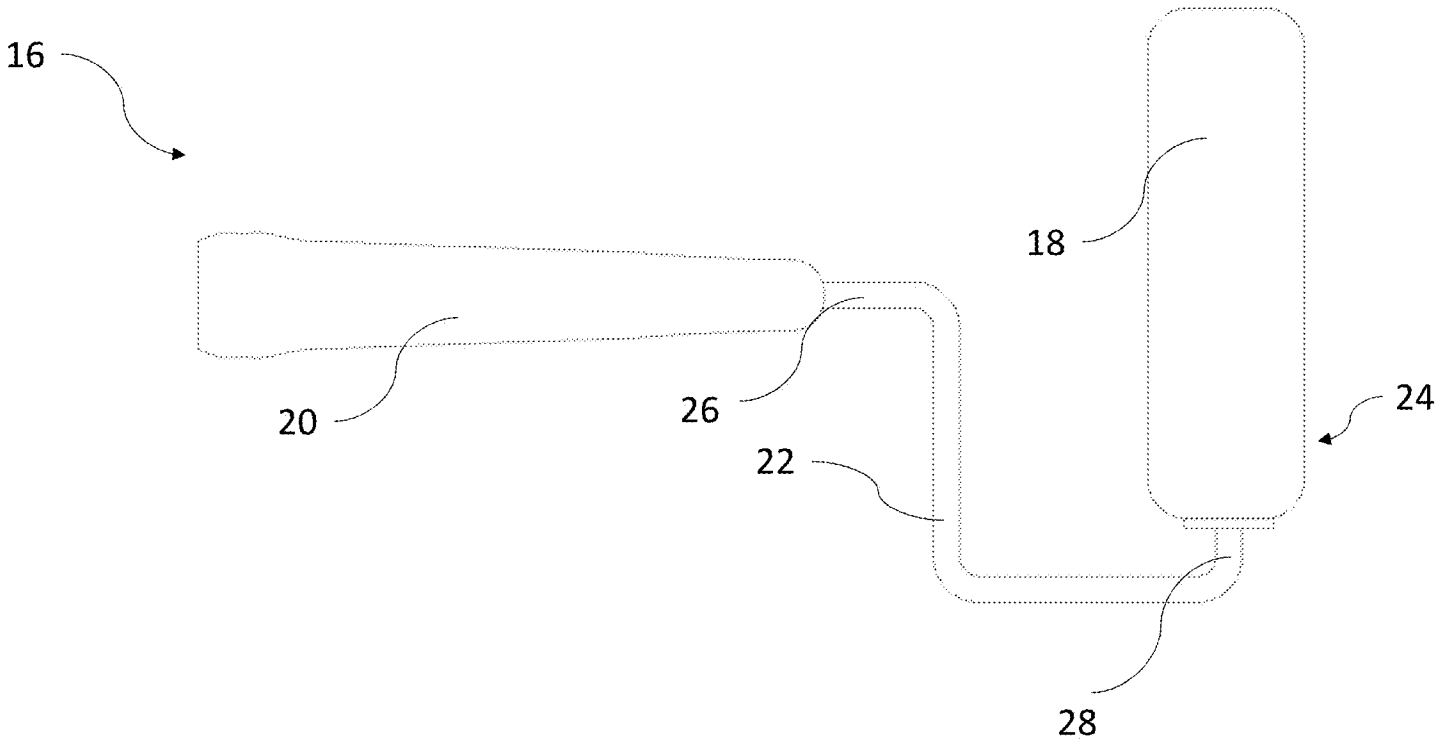
FIG. 1 is a side view of a paint roller frame and cage assembly according to the present invention showing the paint roller frame and cage, a shaft portion and a handle portion.

The principles of the present disclosure have particular application to paint roller frames and cage assemblies. Referring first to FIG. 1, an assembled paint roller frame and cage assembly 16 is used to support a roller cover 18. The paint roller frame and cage assembly 16 includes a hand grip 20, a frame 22 and a cage assembly 24. The hand grip 20 facilitates grasping of the frame 22 with one hand and a threaded socket (not shown) may be provided in the outer end of the hand grip to permit attachment of an extension pole. The frame 22 extends between the hand grip 20 and the cage assembly 24. The frame 22 may be made from a heavy gauge wire or rod bent to shape to provide a handle portion 26 at one end and a shaft portion 28 at the other end for rotatably supporting a cage assembly 24 thereon. The roller cover 18 is supported by the cage assembly 24.

Referring in addition to FIGS. 2-5, the cage assembly 24 includes a substantially rigid one piece cage body 30 that may be formed by injection molding or any suitable manufacturing process. The cage body 30 may be formed of any material suitable for injection molding. An example of a suitable material includes a plastic material such as acetal or a similar thermoplastic material. The cage body 30 has a radially outward surface 32 for uniformly supporting the roller cover 18 thereon. The radially outward surface 32 is formed by a plurality of circumferentially spaced, longitudinally extending roller cover support bars 34 that are joined together at a plurality of axially spaced locations by arcuate surfaces or ribs 36 extending between the support bars 34. The height of the ribs 36 may correspond to the height of the support bars 34 and the ribs 36 may have an outer diameter that is slightly less than the inner diameter of the roller cover.

Figure 2:
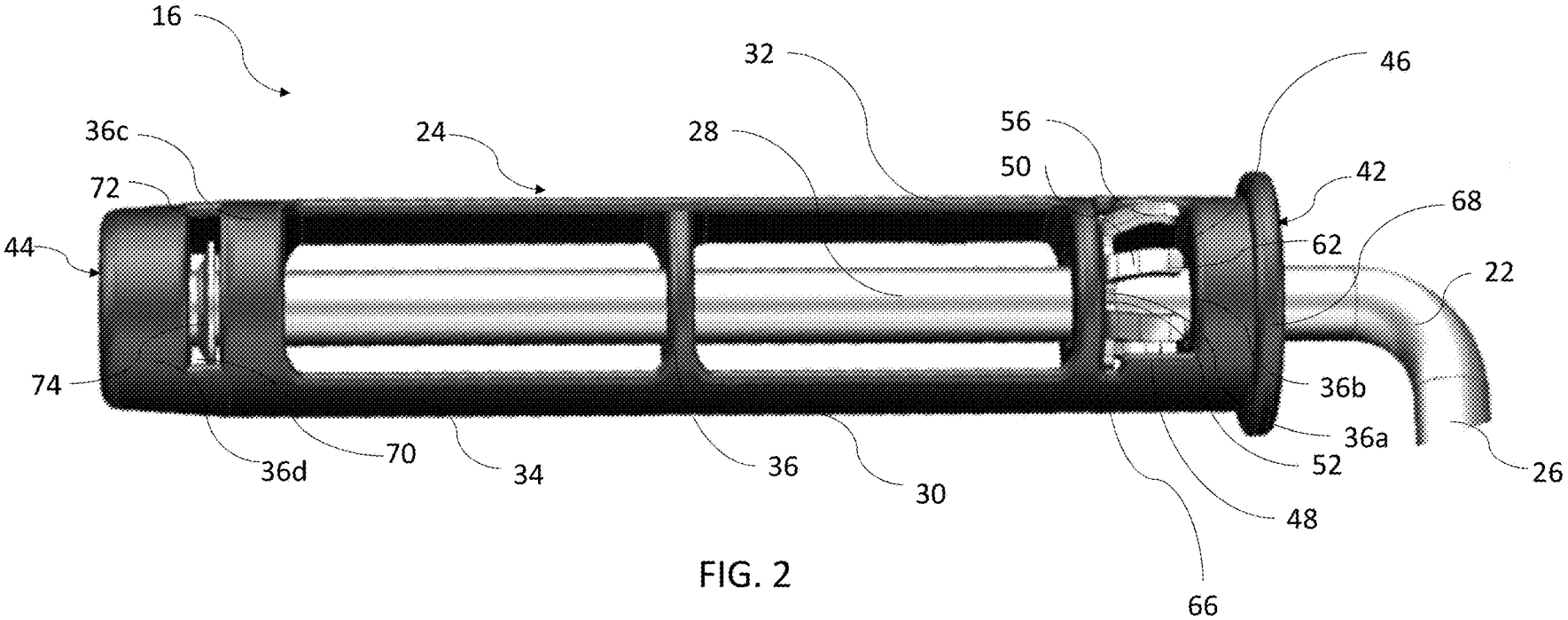
FIG. 2 is a perspective view of the paint roller frame and cage assembly of FIG. 1.
Figure 3:
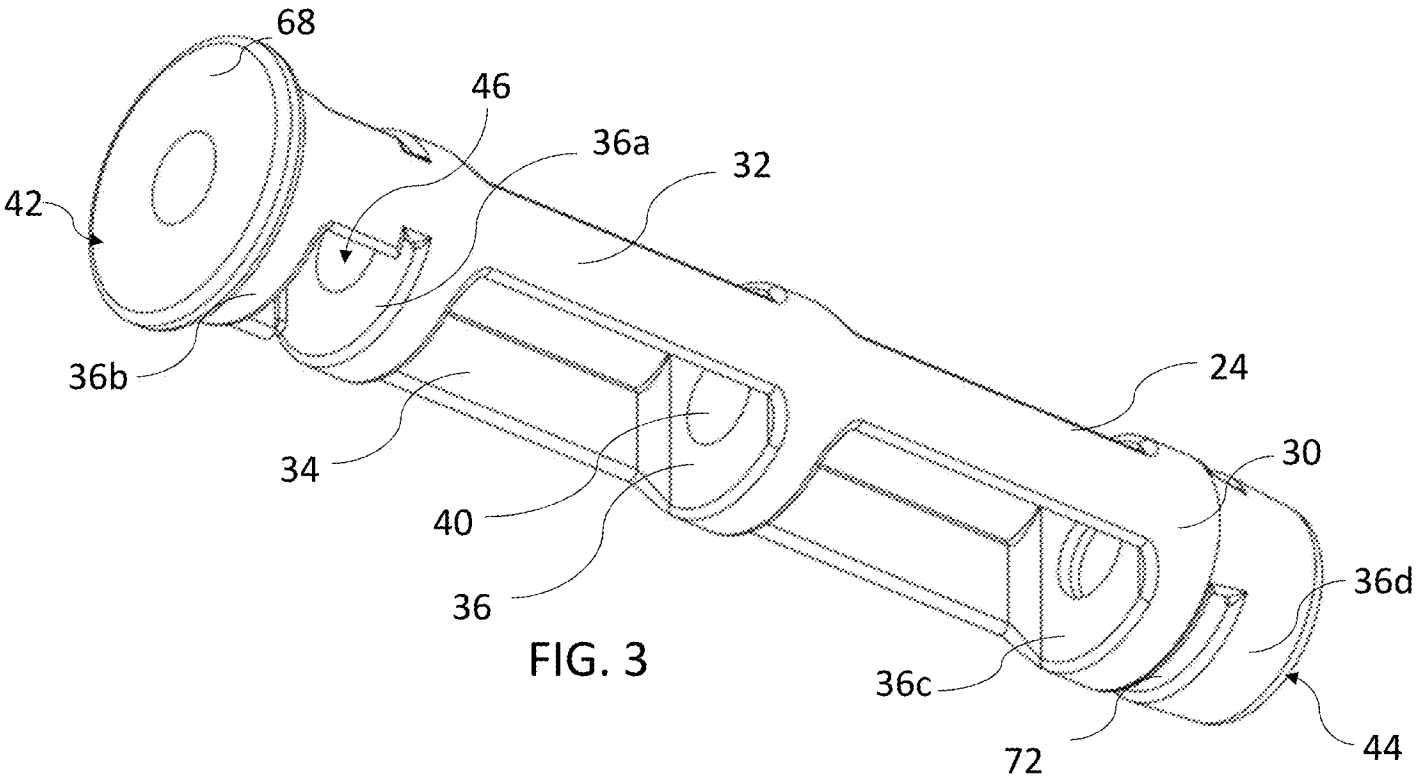
FIG. 3 is a perspective view of the paint roller cage of FIG. 1.
Figure 4:
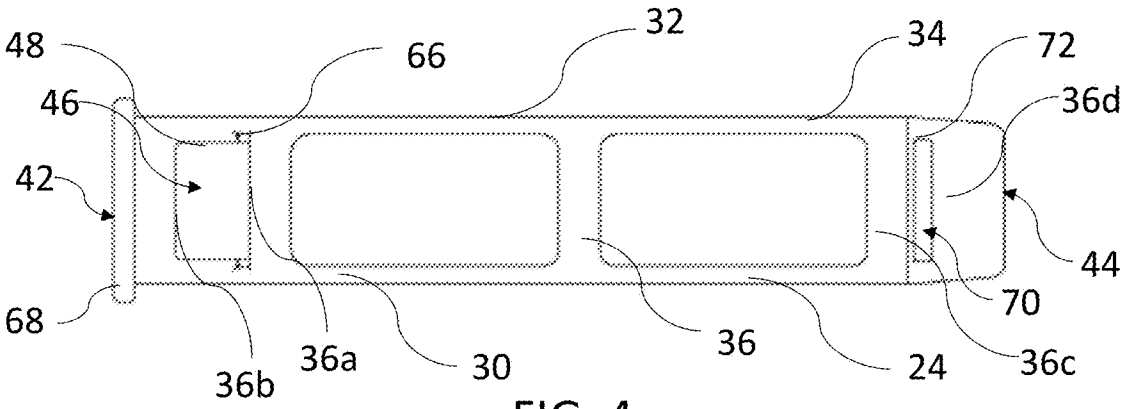
FIG. 4 is a top view of the paint roller cage of FIG. 1.
Figure 5:
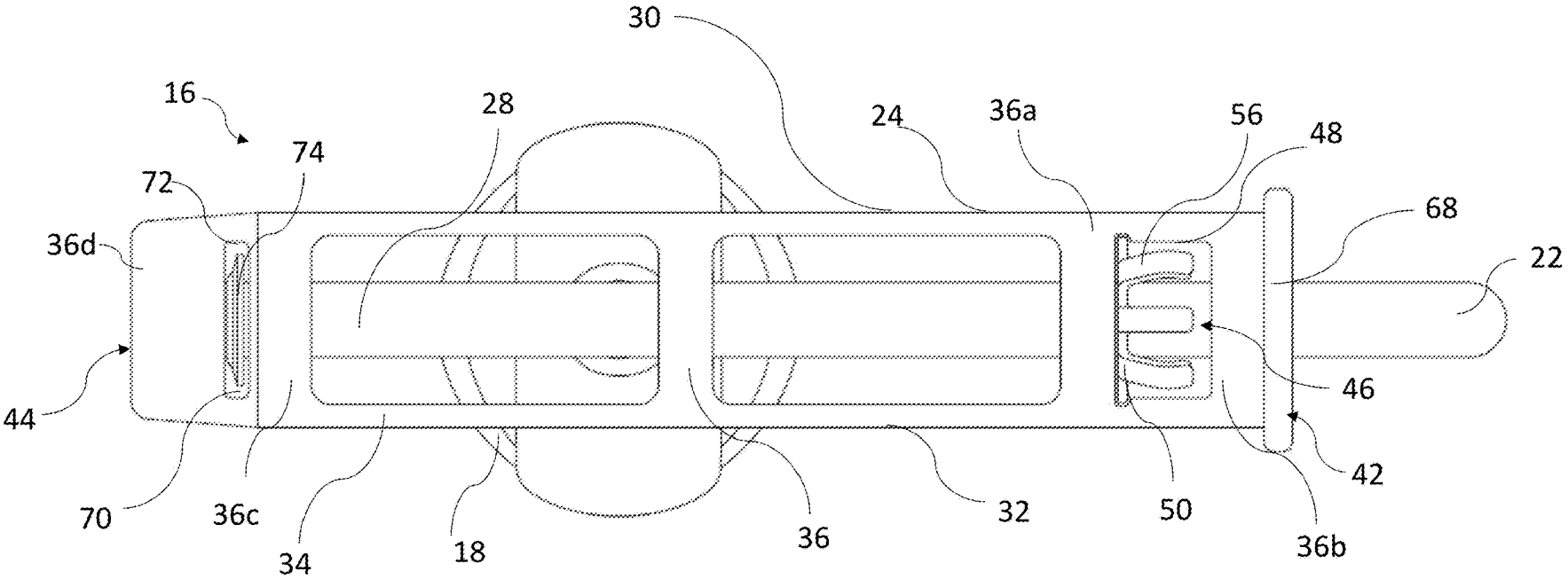
FIG. 5 is a top view of the paint roller frame and cage assembly of FIG. 1 showing a cover retainer and a push-on fastener.

As best shown in FIG. 2, the ribs 36 may each include a shaft-receiving aperture 40 (shown in FIG. 3) for receiving the shaft portion 28 therethrough (shown in FIGS. 2 and 5). The shaft-receiving aperture 40 has a diameter that is slightly larger than the diameter of the shaft portion 28, such that lateral movement of the shaft portion 28 is restricted relative to the cage body 30, while also enabling the shaft portion 28 to rotate during use. In an exemplary embodiment, the shaft-receiving aperture 40 may have a diameter of approximately 0.28 inches and the diameter of the shaft portion 28 may be approximately 0.25 inches, but many other dimensions may be suitable.

Any suitable number of support bars 34 and ribs 36 may be used and the support bars 34 and the ribs 36 may be formed integrally such that the cage body 30 is a unitary component. As shown in FIGS. 1-4, two support bars 34 may be used and the support bars 34 may be spaced approximately 180 degrees from one another. In an exemplary embodiment, the distance between the support bars 34 may be between 0.50 and 0.60 inches. The support bars 34 extend from a first end 42 of the cage body 30 located proximate the handle portion 26 toward a second end 44 of the cage body 30 opposite the first end 42. The support bars 34 may extend continuously between the first end 42 and the second end 44. Each of the support bars 34 are parallel with and circumferentially spaced from the shaft portion 28. In an exemplary embodiment, the cage body 30 may have a length between 3.5 and 4.0 inches and a diameter between 0.70 and 0.80 inches. The shaft portion 28 may have a length between 3.0 and 5.0 inches. Many other dimensions may be suitable.

The cage body 30 includes a pocket such as a first cavity 46 defined within the radially outward surface 32. The first cavity 46 is defined between two radially spaced support bars 34 and two axially spaced annular ribs 36. The first cavity 46 may be located proximate the first end 42 of the cage body 30. The first cavity 46 has a clearance or a first slot 48 that opens radially to the radially outward surface 32.

The paint roller frame and cage assembly 16 includes a cover retainer 50 (shown in FIGS. 2 and 5) that is receivable within the first cavity 46. The first slot 48 has an axial width and a radial length that allows the cover retainer 50 to pass radially through the radially outward surface 32 and into the first cavity 46 during assembly of the paint roller frame and cage assembly 16, such that the cover retainer 50 may be "dropped" or inserted into the cage body 30 before the shaft portion 22 is inserted into the cage body 30. The length of the first slot 48 is defined by peripheral edges of the support bars 34 and the width of the first slot 48 is defined between two ribs 36.

Figure 7:
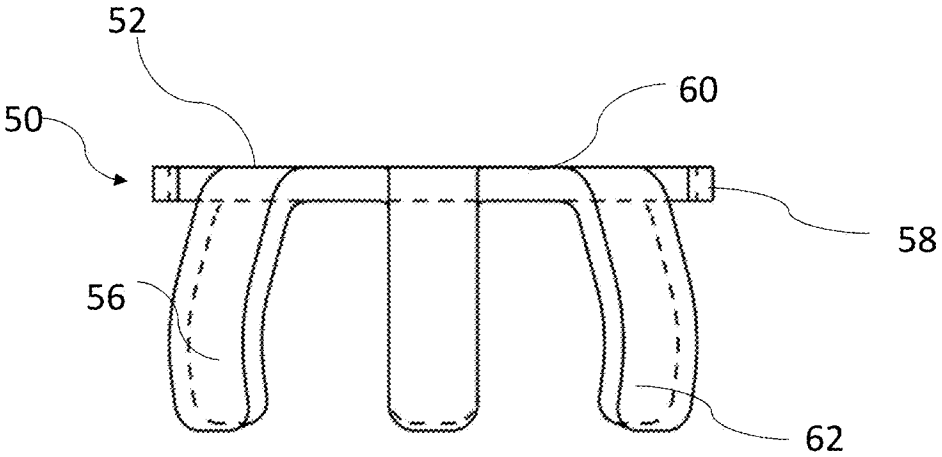
FIG. 7 is a side view of the cover retainer of FIG. 5.
Figure 6:
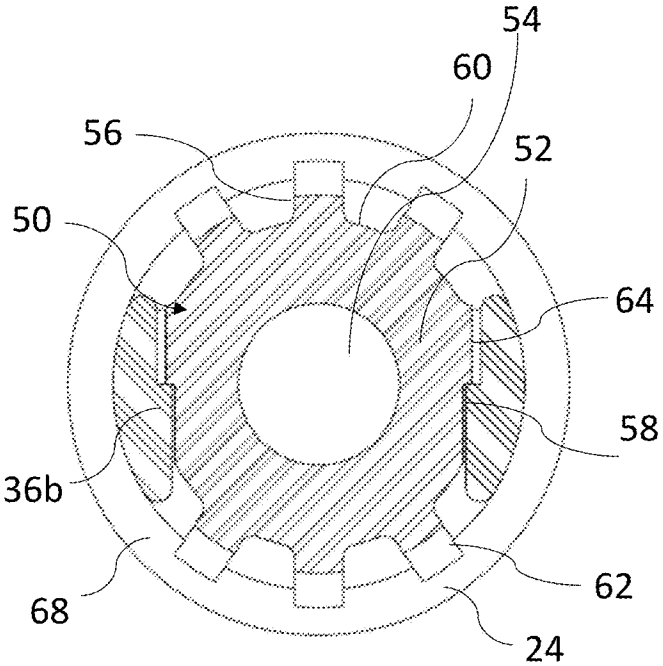
FIG. 6 is a sectional view of the cover retainer and paint roller cage of FIG. 5.

With further reference to FIG. 6-8, the cover retainer 50 has an annular base portion 52 having a central aperture 54 for receiving the shaft portion 28 therethrough. The central aperture 54 has a diameter that is larger than the diameter of the shaft portion 28 to enable lateral shifting and adjustment of the cover retainer 50 relative to the shaft portion 28 during insertion of the roller cover 18 over the cage body 30. The diameter of the central aperture 54 of the cover retainer 50 may be larger than the shaft-receiving apertures 40 of the annular ribs 36. The cover retainer 50 may have a plurality of resilient fingers 56 that extend axially from the annular base portion 52 and radially outwardly from the annular base portion 52. As best shown in FIG. 2, the plurality of fingers 56 extend through the first slot 48 and past the radially outward surface 32 to engage an inner surface of the roller cover 18 supported by the cage body 30. In an exemplary embodiment, the fingers 56 of the cover retainer 50 may extend to an outer diameter between 0.75 and 0.80 inches.

When the fingers 56 engage the roller cover 18, the roller cover self-centers for securement with the cage body 30.

As best shown in FIGS. 6-8C, the cover retainer 50 has an outer peripheral surface with at least one straight edge surface 58 and at least one circumferential surface 60 adjacent the edge surface 58. The plurality of fingers 56 extend from the circumferential surface 60 and the cover retainer 50 may have any suitable number of fingers. In the exemplary configuration shown, the annular base portion 52 includes two edge surfaces 58 on opposite sides of the annular base portion 52, two circumferential surfaces 60 that are each adjacent the edge surfaces 58, and three fingers 56 extending from each circumferential surface 60. The fingers 56 have a width that is less than a width of the first slot 48.

The cover retainer 50 may be in the form of a retaining spring and any suitable spring may be used. For example, a spider spring is suitable. The spring may be formed of any suitable material, such as a metal material. During axial movement of the roller cover 18 over the cage body 30, the fingers 56 are tensioned radially inwardly into the cavity 46. When the fingers 56 are in the tensioned position, the fingers 56 engage the inner diameter of the roller cover 18 over approximately one-third of the length of the fingers 56. The outermost ends 62 of the fingers 56 taper slightly radially and axially inwardly from the inner diameter of the roller cover 18 to prevent the outermost ends 62 of the fingers 56 from digging into the roller cover 18 during removal of the roller cover 18 from the cage body 30.

The total tension force exerted by the cover retainer 50 against the inner diameter of the roller cover 18 is sufficient to securely fasten the roller cover 18 to the cage body 30 during use, i.e. during painting, while also enabling easy removal of the roller cover 18 via a single pull of the roller cover 18. Providing the cover retainer 50 proximate the first end 42 of the roller cage 30 may be advantageous in enabling removal of the roller cover 18 via a gentle tap of the frame 22 on the edge of a paint can or another similar hard surface. Moreover, since the normal tolerance variations of the roller covers used with the roller frame and cage assembly of the present invention are relatively small in comparison to the overall deflection of the fingers 56, the tension force exerted by the cover retainer 50 on such roller covers is substantially uniform. Using the cover retainer 50 may be advantageous in that the cover retainer 50 provides the force for retaining the roller cover to the cage body 30, such that the assembly may not require any other additional component for securing the roller cover to the roller cage.

Figure 8B:
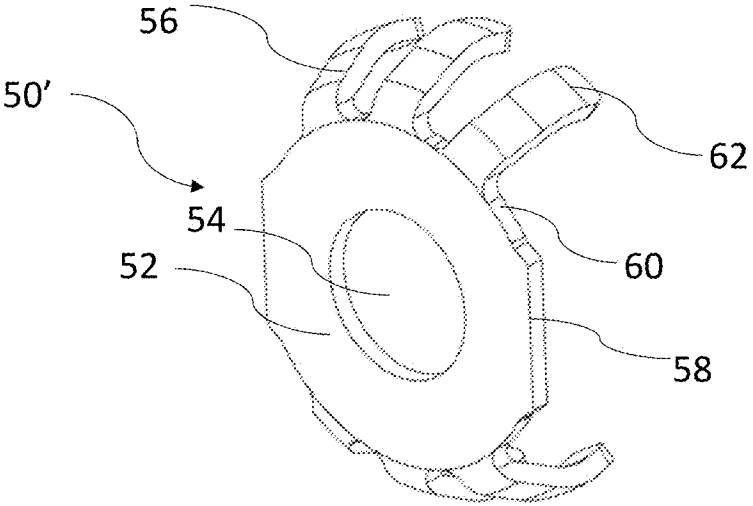
FIG. 8B is a perspective view of the cover retainer in accordance with a second embodiment.
Figure 8A:
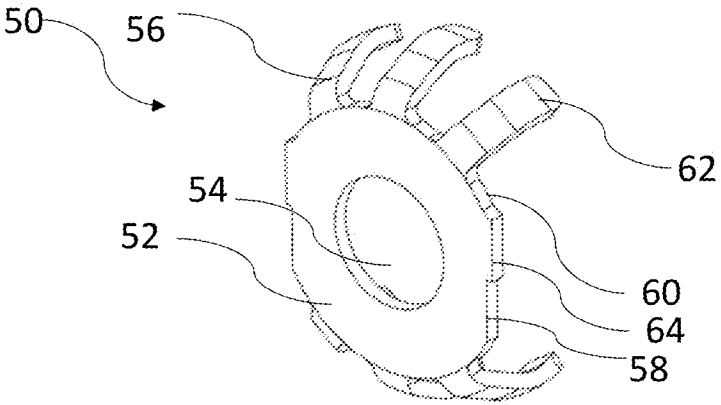
FIG. 8A is a perspective view of the cover retainer of FIG. 5.
Figure 8C:
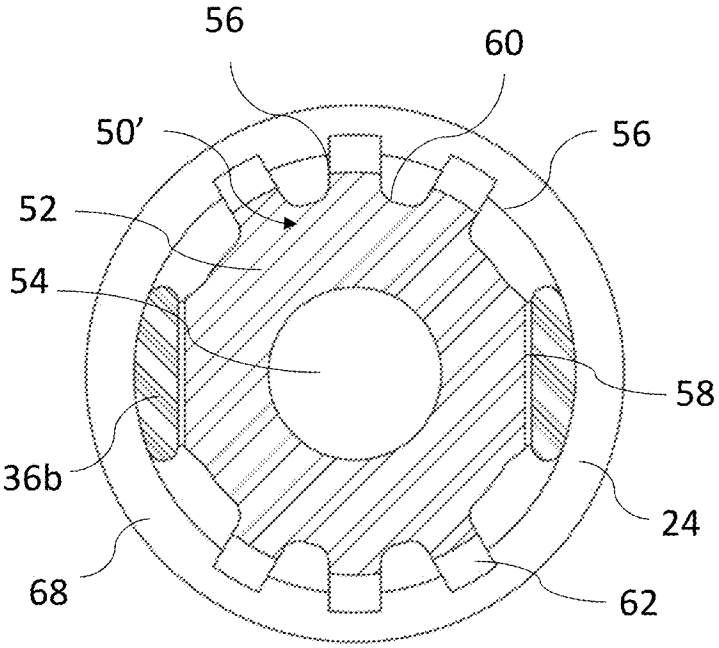
FIG. 8C is a sectional view of the cover retainer and paint roller cage of FIG. 8B.

As best shown in FIGS. 6 and 8A, each edge surface 58 may include a stepped surface 64 that protrudes radially outwardly from the edge surface 58. The first slot 48 includes an annularly extending t-shaped notch 66 that allows the stepped surface 64 to pass radially therethrough into the first cavity 46. The stepped surface 64 is also engageable within the t-shaped notch 66 to locate the cover retainer 50 and keep the cover retainer 50 centered during insertion of the shaft portion 28 through the cover retainer 50. As shown in FIGS. 8B and 8C, an alternative embodiment of the cover retainer 50' may include the fingers 56 being spaced more closely to each other. The cover retainer 50' may include the edge surface 58 without a stepped portion.

When the cover retainer 50 is inserted into the first cavity 46 and the roller cover is inserted over the cage body 30, the annular base portion 52 may engage against an annular surface of one of the ribs 36*a* of the cage body 30. An annular surface of the rib 36*a* may prevent axial movement of the cover retainer 50. A second rib 36*b* opposite the rib 36*a* defines the other end of the first cavity 46. The cage body 30 also has a stop flange that is formed as an outer peripheral ledge 68 located at the first end 42 and adjacent the first slot 48. The outer peripheral ledge 68 extend radially outwardly from the radially outward surface 32 and has an outer diameter that is greater than the outer diameter of the radially outward surface 32. In an exemplary embodiment, the outer peripheral ledge 68 may have a diameter between 0.86 and 0.88 inches. During assembly, the roller cover 18 axially moves over the radially outward surface 32 until the roller cover 18 engages the outer peripheral ledge 68. When the roller cover 18 engages the outer peripheral ledge 68, the cover retainer 50 engages the roller cover 18 and the roller cover 18 is fully inserted on the cage body 30.

Figure 9:
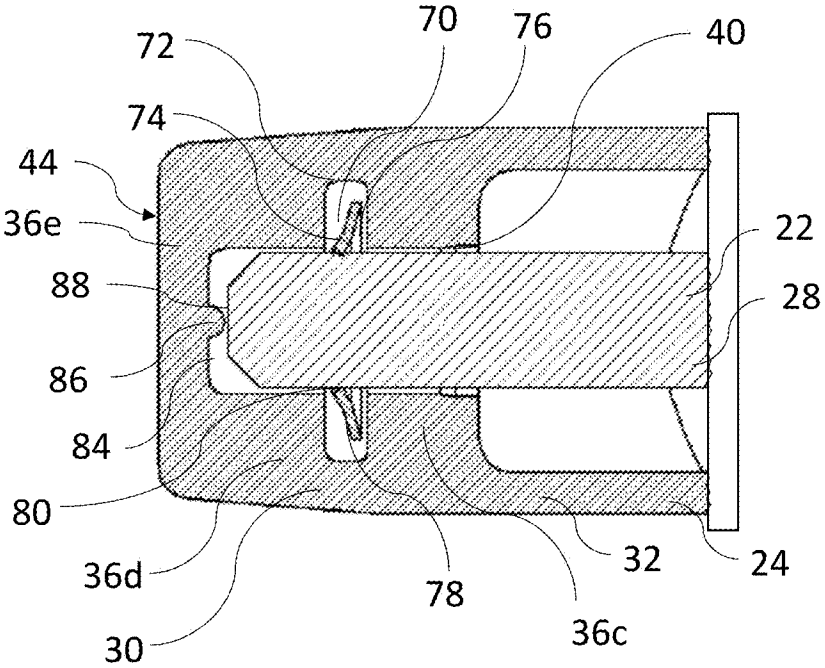
FIG. 9 is a sectional view of the paint roller frame and cage assembly of FIG. 5 showing the push-on fastener and a shaft portion.
Figure 11:
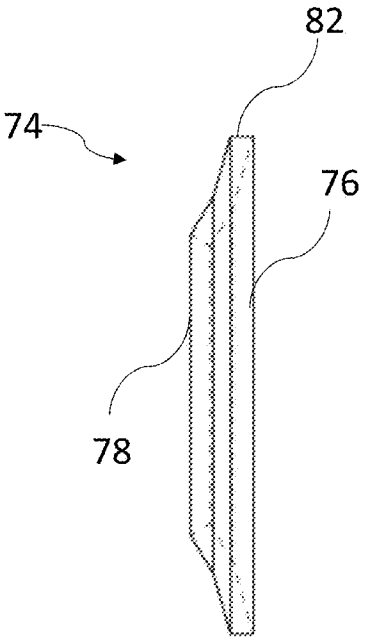
FIG. 11 is a side view of the push-on fastener of FIG. 10.
Figure 10:
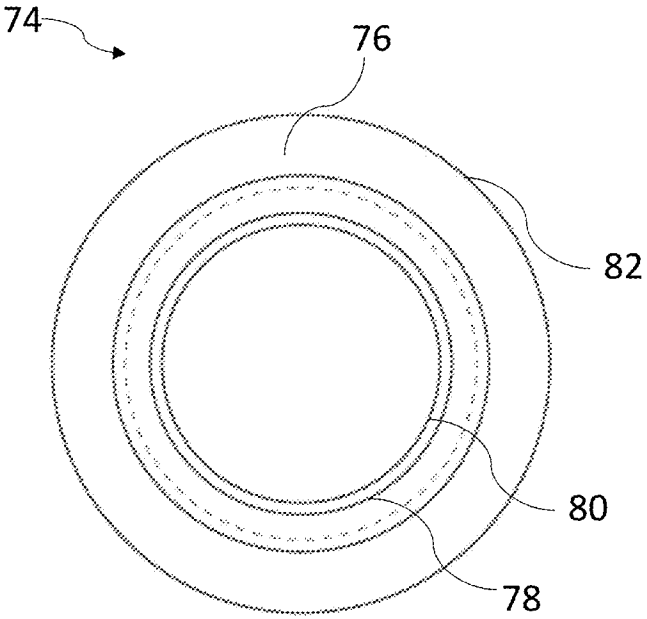
FIG. 10 is a front view of the push-on fastener of FIG. 9.

With additional reference to FIGS. 9-11, the cage body 30 further has a second cavity 70 defined within the radially outward surface and located at the second end of the cage body 30. The second cavity 70 may have a width that is less than the width of the first cavity 46. The second cavity 70 and the first cavity 46 may have the same or a similarly sized diameter. In an exemplary embodiment, the width of the first cavity 46 may be approximately 0.32 inches and the width of the second cavity 70 may be approximately 0.08 inches. The diameter of the first cavity 46 and the second cavity 70 may be approximately 0.52 inches. The second cavity 70 has a second slot 72 that opens radially to the radially outward surface 32 for receiving a push-on fastener 74 that is inserted into the second cavity 70.

The push-on fastener 74 is used to hold the cage body 30 onto the shaft portion 28 of the frame wire when assembled. The cage body 30 is retained against axial movement on the shaft portion 28 via the push-on fastener 74. The second slot 72 has an axial width and a radial length that allows the push-on fastener 74 to pass radially through the radially outward surface 32 and into the second cavity 70 during assembly of the paint roller frame and cage assembly 16, such that the fastener 74 may be "dropped" or "pushed" into the cage body 30 before the shaft portion 28 is inserted into the cage body 30. The length of the second slot 72 is defined by the support bars 32 and the width of the second slot 72 is defined between two ribs 36*c*, 36*d*. The width of the second slot 72 may be less than the width of the first slot 48.

During assembly, the cage body 30 is placed into a fixture or nest for restraining the cage body 30. The restraining fixture or nest has two or more fixed protrusions that enter the first cavity 46, the second cavity 70, and other void spaces of the cage body 30. These fixed protrusions in the first cavity 46 and the second cavity 70 are shaped such that the cover retainer 50 and the push-on fastener 74 are supported on their outer shape while at the same time aligning their inside diameters axially to the inserted shaft portion 28. The push-on fastener 74 also has a "lead" feature that serves a self-centering function between the inner diameter 80 of the push-on fastener 74 and the outside diameter of the shaft portion 28.

Any suitable type of push-on fastener 74 may be used to secure the cage body 30 to the shaft portion 28. For example, a nut type or washer type fastener may be used. A thin wall stud receiver or a speed nut may be suitable. The push-on fastener 74 may have any suitable shape, such as a circular shape or a u-shape. The push-on fastener 74 may be formed of any suitable material, such as a 300-series stainless steel. The fastener 74 may be circumferentially continuous. The push-on fastener 74 has a flat annular base surface 76 that is engageable against an annular surface of the rib 36*c*. The push-on fastener 74 has a circumferential flange 78 that tapers in an axial direction from the flat annular base surface 76. The push-on fastener 74 has an inner diameter 80 that receives the shaft portion 28 therethrough and the inner diameter 80 may be only slightly larger than the diameter of the shaft portion 28 for securing the push-on fastener 74 to the shaft portion 28. The push-on fastener 74 has an outer diameter 82 that is smaller than an outer diameter of the radially outward surface 32.

In an exemplary embodiment, the inner diameter 80 may have circumferential teeth that bite into the shaft portion 28 to secure the push-on fastener 74 to the shaft portion 28. The inner diameter 80 of the fastener 74 may be less than the diameter of the apertures 40 defined in the ribs 36 of the cage body 30. In an exemplary embodiment, the inner diameter 80 may be between 0.16 and 0.25 inches and the outer diameter 82 may be between 0.40 and 0.45 inches. The push-on fastener 74 may have a thickness between 0.04 and 0.07 inches. The aforementioned dimensions are exemplary and many other dimensions may be suitable.

As best shown in FIG. 9, the cage body 30 further has a third cavity 84 defined within the radially outward surface 32 and between an end wall 36*e* of the cage body 30 and the second cavity 70. The third cavity 84 may have a diameter that is slightly larger than the outer diameter of the shaft portion 28 such that the shaft portion 28 is restricted from lateral movement within the third cavity 84. The end wall 36*e* may have an axial protrusion 86 that protrudes from an inner surface of the end wall 36*e* to engage the shaft portion 28 and prevent axial movement of the shaft portion 28 upon insertion of the shaft portion 28 through the cage body 30. The end wall 36*e* has a diameter that is less than the diameter of the rest of the radially outward surface 32 of the cage body 30 such that the roller cover 18 is easily initially inserted or slid over the end wall 36*e* and onto the cage body 30 without excessive exertion or force. The radially outward surface 32 is tapered from the rib 36*c* proximate the second cavity 70 toward the end wall 36*e* proximate the third cavity 84.

The cage body 30 may be injection-molded as a unitary component such that all of the cavities 46, 70, 84 are molded pockets within the cage body 30. In an exemplary embodiment, a first portion of the cage body 30 that extends from the first end 42 to the rib 36*c* may be injection-molded as a single component and a second portion of the cage body 30 that extends from the rib 36*c* to the second end 44 may be injection-molded as another single component. The first portion may include the support bars 34 and the first cavity 46 that receives the cover retainer 50, and the second portion may include the third cavity 84 and the second cavity 70 that receives the push-on fastener 74. The second portion may be subsequently attached or formed to the first portion such that the connection between the portions is seamless and the radially outer portion 32 is continuous from the first end 42 to the second end 44 of the cage body 30.

During assembly of the paint roller frame and cage assembly 16, the shaft portion 28 is inserted through a shaft-receiving aperture of the rib 36*b* (shown in FIGS. 2-5), the first cavity 46 and the cover retainer 50 received within the first cavity 46 (shown in FIGS. 2 and 5), a shaft-receiving aperture of the rib 36*a*, the shaft-receiving aperture 40 of at least one rib 36 disposed in the middle of the cage body 30 (shown in FIG. 3), a shaft-receiving aperture of the rib 36*c*, the second cavity 70 and the fastener 74 received within the second cavity 70 (shown in FIGS. 2 and 5), and the third cavity 84 defined by the rib 36*d*. The shaft portion 28 is axially moveable until an end 88 of the shaft portion 28 contacts the end wall 36*e* or the axial protrusion 86. The cage body 30 is secured to the shaft portion 28 once the shaft portion 28 is inserted through the push-on fastener 74.

When the shaft portion 28 contacts the end wall 36*e* and the shaft portion 28 is fully inserted into the cage body 30, the roller cover 16 (shown in FIG. 1) is inserted over the cage body 30 in an axial direction that is opposite to the insertion direction of the shaft portion 28. Alternatively, the cage body 30 may be retained against axial movement on the shaft portion 28 by staking the shaft portion 28. The roller cover 18 extends over the tapered end portion of the cage body 30 and axially moves over the cage body 30 until the roller cover 18 engages against the outer peripheral ledge 68 (shown in FIG. 1-4). As the roller cover 18 passes over the cover retainer 50, the fingers 56 of the cover retainer 50 are flexible in the radially inward direction to enable the roller cover 18 to pass over the cage body 30 (shown in FIGS. 2 and 5). The fingers 56 retain the roller cover 18 by bending radially outwardly to engage the inner diameter of the roller cover 18.

The paint roller frame and cage assembly 16 disclosed herein is advantageous in that the assembly enables easy insertion of the shaft portion 28 into the cage body 30 and easy insertion or removal of the roller cover from the cage body 30, such that a user can quickly begin to use the roller cover to paint and quickly replace the roller cover without exerting an undesirable amount of force. Using the molded cavities 46, 47 and "drop-in" slots 48, 72 is advantageous in enabling the cover retainer 50 and the push-on fastener 74 to be easily inserted into the cage body 30 before inserting the shaft portion 28 into the cage body 30.

Using the cover retainer 50 is advantageous in that the cover retainer 50 provides the force for retaining the roller cover over the cage body 30. Thus, the cage body 30 may be formed with fewer complex features and components as compared with prior cages that required more complex features or more components to retain the roller cover. Using the push-on fastener 74 further enables the cage body 30 to have fewer complex features in that the push-on fastener 74 holds the cage body 30 onto the shaft portion 28 and the cage body 30. Generally, the unitary cage body 30, the cover retainer 50, and the push-on fastener 74 provide an easy-to-assemble and secure paint roller frame and cage assembly.

A paint roller frame and cage assembly includes a paint roller frame having a handle portion and a shaft portion that extends from the handle portion and a paint roller cage being rotatably mounted on the shaft portion. The paint roller cage has a radially outward surface for uniformly supporting a roller cover thereon and a first cavity having a first slot opening radially to the radially outward surface of the paint roller cage. The assembly includes a cover retainer receivable within the first cavity for securing a roller cover to the paint roller cage and the first slot has a width to allow the cover retainer to pass radially into the first cavity from outside the paint roller cage.

The cover retainer includes a central aperture that receives the shaft portion therethrough and the central aperture has a diameter that is larger than a diameter of the shaft portion to allow lateral shifting of the cover retainer relative to the shaft portion during insertion of the roller cover over the paint roller cage.

The cover retainer may have a plurality of resilient fingers that extend through the first slot to engage an inner surface of the roller cover.

The cover retainer may include an annular base portion having at least one edge surface and at least one circumferential surface adjacent the edge surface, wherein the plurality of fingers extends from the circumferential surface.

The edge surface may have a stepped surface that protrudes outwardly from the edge surface, wherein the first slot has a radially extending t-shaped notch that allows the stepped surface to pass therethrough into the first cavity, and wherein the stepped surface is engageable with the t-shaped notch to align the cover retainer during insertion of the shaft portion into the paint roller cage.

The plurality of fingers may have a width that is less than the width of the first slot.

The paint roller cage may include a ledge adjacent the first slot that extends radially outwardly from the radially outward surface to prevent axial movement of the roller cover when the roller cover is fully inserted on the paint roller cage.

The paint roller frame and cage assembly further includes a second cavity having a second slot opening radially to the radially outward surface, and a push-on fastener that is receivable within the second cavity for holding the paint roller cage onto the shaft portion. The second slot has a width to allow the push-on fastener to pass radially into the second cavity from outside the paint roller cage.

The width of the second slot may be less than the width of the first slot.

The push-on fastener may be circumferentially continuous and include an inner diameter that receives the shaft portion therethrough and an outer diameter that is less than a diameter of the radially outward surface.

The paint roller frame and cage assembly may include a third cavity defined within the radially outward surface and between an end wall of the paint roller cage and the second cavity, wherein an end of the shaft portion is insertable through both the second cavity and the third cavity to engage the end wall.

The radially outward surface may be tapered radially inwardly from the second cavity toward the third cavity to enable easy insertion of the roller cover over the paint roller cage.

The first cavity may be located at a first end of the paint roller cage and the second cavity may be located at a second end of the paint roller cage opposite the first end, and the radially outward surface may extend continuously from the first end of the paint roller cage to the second end of the paint roller cage.

The cover retainer may be a spring.

A paint roller frame and cage assembly includes a paint roller frame having a handle portion and a shaft portion that extends from the handle portion and a paint roller cage being rotatably mounted on the shaft portion. The paint roller cage has a radially outward surface for uniformly supporting a roller cover thereon and a cavity having a slot opening radially to the radially outward surface of the paint roller cage. The assembly includes a push-on fastener receivable within the cavity, wherein the push-on fastener has an inner diameter that receives the shaft portion therethrough to hold the paint roller cage onto the shaft portion. The slot has a width to allow the fastener to pass radially into the cavity from outside the paint roller cage.

The push-on fastener may be a speed nut or a thin wall stud receiver.

The paint roller frame and cage assembly may include an end cavity defined within the radially outward surface and between an end wall of the paint roller cage and the cavity that receives the push-on fastener, wherein an end of the shaft portion is insertable through both the cavity that receives the push-on fastener and the end cavity to engage the end wall.

The radially outward surface may be tapered radially inwardly from the second cavity toward the third cavity to enable easy insertion of the roller cover over the paint roller cage.

The push-on fastener may include an outer diameter that is smaller than an outer diameter of the radially outward surface.

A paint roller frame and cage assembly includes a paint roller frame having a handle portion and a shaft portion that extends from the handle portion and a paint roller cage being rotatably mounted on the shaft portion. The paint roller cage has a radially outward surface for uniformly supporting a roller cover thereon, a first cavity located at one end of the paint roller cage that has a first slot opening radially to the radially outward surface of the paint roller cage, and a second cavity located at an opposite end of the paint roller cage that has a second slot opening radially to the radially outward surface of the paint roller cage. The assembly includes a cover retainer receivable within the first cavity for securing a roller cover to the paint roller cage, wherein the first slot has a width to allow the cover retainer to pass radially into the first cavity from outside the paint roller cage. The assembly includes a push-on fastener receivable within the second cavity to hold the paint roller cage onto the shaft portion, wherein the second slot has a width to allow the push-on fastener to pass radially into the second cavity from outside the paint roller cage. The paint roller cage is formed as a unitary body and the radially outward surface extends continuously from the first end of the paint roller cage to the second end of the paint roller cage.

A method of manufacturing a paint roller frame and cage assembly includes forming a paint roller cage having a radially outward surface for uniformly supporting a roller cover thereon, a first cavity located at one end of the paint roller cage that has a first slot opening radially to the radially outward surface of the paint roller cage, and a second cavity located at an opposite end of the paint roller cage that has a second slot opening radially to the radially outward surface of the paint roller cage. The method further includes radially inserting a cover retainer through the first slot and into the first cavity from outside the paint roller cage and radially inserting a push-on fastener through the second slot and into the second cavity from outside the paint roller cage. The method further includes rotatably mounting the paint roller cage on a shaft portion of a paint roller frame having a handle portion from which the shaft portion extends.

Forming the paint roller cage may include using an injection molding process.

Forming the paint roller cage may include forming the paint roller cage as a unitary body.

The method may include forming the cover retainer to have an annular base portion having at least one edge surface and at least one circumferential surface adjacent the edge surface, wherein a plurality of fingers extends from the circumferential surface.

The method may include centering the cover retainer during insertion of the shaft portion through the cover retainer using a stepped surface that protrudes outwardly from the edge surface of the cover retainer, wherein the first slot has a radially extending t-shaped notch that allows the stepped surface to pass therethrough into the first cavity, and wherein the stepped surface is engageable with the t-shaped notch.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A paint roller frame and cage assembly comprising:

a paint roller frame having a handle portion and a shaft portion that extends from the handle portion, a paint roller cage being rotatably mounted on the shaft portion, the paint roller cage having a radially outward surface for uniformly supporting a roller cover thereon and a first cavity having a first slot opening radially to the radially outward surface of the paint roller cage; and a cover retainer receivable within the first cavity for securing a roller cover to the paint roller cage, wherein the first slot has a width to allow the cover retainer to pass radially into the first cavity from outside the paint roller cage, wherein the cover retainer has a plurality of resilient fingers that extend through the first slot to engage an inner surface of the roller cover.

2. The paint roller frame and cage assembly according to claim 1, wherein the cover retainer includes a central aperture that receives the shaft portion therethrough, the central aperture having a diameter that is larger than a diameter of the shaft portion to allow lateral shifting of the cover retainer relative to the shaft portion during insertion of the roller cover over the paint roller cage.

3. The paint roller frame and cage assembly according to claim 1, wherein the cover retainer includes an annular base portion having at least one edge surface and at least one circumferential surface adjacent the edge surface, wherein the plurality of fingers extends from the circumferential surface.

4. The paint roller frame and cage assembly according to claim 3, wherein the edge surface includes a stepped surface that protrudes outwardly from the edge surface, wherein the first slot has a radially extending t-shaped notch that allows the stepped surface to pass therethrough into the first cavity, and wherein the stepped surface is engageable with the t-shaped notch to align the cover retainer during insertion of the shaft portion into the paint roller cage.

5. The paint roller frame and cage assembly according to claim 1, wherein the paint roller cage includes a ledge adjacent the first slot, the ledge extending radially outwardly from the radially outward surface to prevent axial movement of the roller cover when the roller cover is fully inserted on the paint roller cage.

6. The paint roller frame and cage assembly according to claim 1 further comprising:

a second cavity having a second slot opening radially to the radially outward surface; and a push-on fastener that is receivable within the second cavity for holding the paint roller cage onto the shaft portion, wherein the second slot has a width to allow the push-on fastener to pass radially into the second cavity from outside the paint roller cage.

7. The paint roller frame and cage assembly according to claim 6, wherein the push-on fastener is circumferentially continuous, the push-on fastener including an inner diameter that receives the shaft portion therethrough and an outer diameter that is less than a diameter of the radially outward surface.

8. The paint roller frame and cage assembly according to claim 6 further comprising a third cavity defined within the radially outward surface and between an end wall of the paint roller cage and the second cavity, wherein an end of the shaft portion is insertable through both the second cavity and the third cavity to engage the end wall.

9. The paint roller frame and cage assembly according to claim 8, wherein the radially outward surface is tapered radially inwardly from the second cavity toward the third cavity to enable easy insertion of the roller cover over the paint roller cage.

10. The paint roller frame and cage assembly according to claim 6, wherein the first cavity is located at a first end of the paint roller cage and the second cavity is located at a second end of the paint roller cage opposite the first end, and the radially outward surface extends continuously from the first end of the paint roller cage to the second end of the paint roller cage.

11. A paint roller frame and cage assembly comprising:

a paint roller frame having a handle portion and a shaft portion that extends from the handle portion, a paint roller cage being rotatably mounted on the shaft portion, the paint roller cage having a radially outward surface for uniformly supporting a roller cover thereon and a cavity having a slot opening radially to the radially outward surface of the paint roller cage; and a push-on fastener receivable within the cavity, wherein the push-on fastener has an inner diameter that receives the shaft portion therethrough to hold the paint roller cage onto the shaft portion, wherein the slot has a width to allow the fastener to pass radially into the cavity from outside the paint roller cage, wherein the push-on fastener is a speed nut or a thin wall stud receiver.

12. The paint roller frame and cage assembly according to claim 11 further comprising an end cavity defined within the radially outward surface and between an end wall of the paint roller cage and the cavity that receives the push-on fastener, wherein an end of the shaft portion is insertable through both the cavity that receives the push-on fastener and the end cavity to engage the end wall.

13. The paint roller frame and cage assembly according to claim 12, wherein the radially outward surface is tapered radially inwardly to enable easy insertion of the roller cover over the paint roller cage.

14. A paint roller frame and cage assembly comprising:

a paint roller frame having a handle portion and a shaft portion that extends from the handle portion, a paint roller cage being rotatably mounted on the shaft portion, the paint roller cage having a radially outward surface for uniformly supporting a roller cover thereon, a first cavity located at one end of the paint roller cage that has a first slot opening radially to the radially outward surface of the paint roller cage, and a second cavity located at an opposite end of the paint roller cage that has a second slot opening radially to the radially outward surface of the paint roller cage;

a cover retainer receivable within the first cavity for securing a roller cover to the paint roller cage, wherein the first slot has a width to allow the cover retainer to pass radially into the first cavity from outside the paint roller cage;

a push-on fastener receivable within the second cavity to hold the paint roller cage onto the shaft portion, wherein the second slot has a width to allow the push-on fastener to pass radially into the second cavity from outside the paint roller cage; and an end cavity defined within the radially outward surface and between an end wall of the paint roller cage and the second cavity that receives the push-on fastener, wherein an end of the shaft portion is insertable through both the second cavity that receives the push-on fastener and the end cavity to engage the end wall, wherein the paint roller cage is formed as a unitary body and the radially outward surface extends continuously from the first end of the paint roller cage to the second end of the paint roller cage.

15. A method of manufacturing a paint roller frame and cage assembly, the method comprising:

forming a paint roller cage having a radially outward surface for uniformly supporting a roller cover thereon, a first cavity located at one end of the paint roller cage that has a first slot opening radially to the radially outward surface of the paint roller cage, and a second cavity located at an opposite end of the paint roller cage that has a second slot opening radially to the radially outward surface of the paint roller cage;

radially inserting a cover retainer through the first slot and into the first cavity from outside the paint roller cage;

radially inserting a push-on fastener through the second slot and into the second cavity from outside the paint roller cage;

rotatably mounting the paint roller cage on a shaft portion of a paint roller frame having a handle portion from which the shaft portion extends; and forming the cover retainer to have an annular base portion having at least one edge surface and at least one circumferential surface adjacent the edge surface, wherein a plurality of fingers extends from the circumferential surface.

16. The method of claim 15, wherein forming the paint roller cage includes forming the paint roller cage as a unitary body.

17. The method of claim 15 further comprising centering the cover retainer during insertion of the shaft portion through the cover retainer using a stepped surface that protrudes outwardly from the edge surface of the cover retainer, wherein the first slot has a radially extending t-shaped notch that allows the stepped surface to pass therethrough into the first cavity, and wherein the stepped surface is engageable with the t-shaped notch.

* * * * *